United States Patent [19]

Yamazaki et al.

[11] 4,327,645

[45] May 4, 1982

[54] TIE TAMPER

[75] Inventors: Kazuhide Yamazaki; Masaomi Morisawa, both of Tokyo; Maki Nakajima, Ayase, all of Japan

[73] Assignees: Nippon Kokuyu Tetsudo; Kabushiki Kaisha Shibaura Seisakusho, both of Tokyo, Japan

[21] Appl. No.: 171,815

[22] Filed: Jul. 24, 1980

[30] Foreign Application Priority Data

Aug. 27, 1979 [JP] Japan ..... 54/108892

[51] Int. Cl.[3] ..... E01B 27/00

[52] U.S. Cl. ..... 104/13; 404/133

[58] Field of Search ..... 104/10–14; 404/133

[56] References Cited

U.S. PATENT DOCUMENTS 1,399,387 12/1921 Jackson ..... 104/13

2,239,785 4/1941 Jackson ..... 104/13

2,934,026 4/1960 Beierlein ..... 104/13

*Primary Examiner*—Richard A. Bertsch

*Attorney, Agent, or Firm*—Stevens, Davis, Miller & Mosher

[57] ABSTRACT

The handle of a tie tamper is connected to its vibration generating motor, to which a beater is rigidly fixed to be vibrated thereby, by a combination of a Neidhart damper fixed to one end of the handle, a shackle-link pair fixed at one end to the square shaft of the damper, and an arcuate leaf spring pin-connected at its one end to the link pair and at its other end to the motor and by a two-bar linkage connected at its two ends via Neidhart dampers respectively to an intermediate part of the handle and to the motor, and a balance weight is provided at the pin joint between the two links of the two-bar linkage. This construction greatly reduces the vibration transmitted from the motor to the handle.

3 Claims, 8 Drawing Figures

TIE TAMPER

BACKGROUND OF THE INVENTION

This invention relates generally to hand-held tie tampers for compacting ballast gravel under the lower surfaces of ties of railroad tracks. More specifically, the invention relates to a tie tamper in which a handle to be grasped by the operator and a vibration motor for generating vibration to which a beater is fixed are connected by way of Neidhart dampers and a link mechanism, and balance weights are provided at the pin joint between links in the link mechanism thereby to increase the effect of reducing or suppressing the transmission of vibration from the vibration generating motor to the handle.

A tie tamper known heretofore comprises, essentially, a motor adapted to generate vibration (hereinafter referred to as a "vibromotor"), a beater rigidly fixed to the vibromotor and being vibrated thereby, the beater being thrust into railroad ballast gravel during operation, a handle, and a leaf spring and a support spring joining the handle to the vibromotor, as will be described more fully hereinafter.

The leaf spring is intended to reduce the transmission of vibration from the vibromotor to the handle. However, since the leaf spring has a linear characteristic, the same vibration reducing effect cannot be sustained when the work condition changes. That is, the work condition when the beater is vibrating freely in the air is different from that when it is vibrating after being thrust into ballast gravel. When the beater is thrust deeply into ballast gravel and is constrained, the work condition also changes. Thus, depending on the work condition, intense vibration or impact-like vibration is transmitted to the hands of an operator using the above mentioned tie tamper of known type, as will be described more fully in conjunction with a drawing.

SUMMARY OF THE INVENTION

It is an object of this invention to provide a tie tamper in which almost no vibration is transmitted from the vibromotor to the handle irrespective of the work condition.

Another object of the invention is to provide a tie tamper as stated above which is of relatively simple construction and does not weigh appreciably more than a conventional tie tamper of equivalent performance.

According to this invention, briefly summarized, there is provided a tie tamper comprising: a motor adapted to generate vibration as output; a beater designed to be thrust at a distal end thereof into ballast gravel and rigidly fixed at its proximal end to the motor to be vibrated thereby; a handle to be grasped by an operator of the tie tamper; a support mechanism connecting one end of the handle to the motor and comprising a support spring connected at one end thereof to a part of the motor, a first Neidhart damper secured to said one end of the handle and having a non-cylindrical shaft disposed therein, and a first link fixed at one end thereof to the non-cylindrical shaft and connected at the other end thereof to the other end of the support spring; a link mechanism connecting an intermediate part of the handle to the motor and comprising a second Neidhart damper secured to the motor and having a non-cylindrical shaft disposed therein, a third Neidhart damper secured to said intermediate part of the handle and having a non-cylindrical shaft disposed therein, a second link fixed at one end thereof to the shaft of the second Neidhart damper, and a third link fixed at one end thereof to the shaft of the third Neidhart damper and pin-connected at the other end thereof to the other end of the second link, the second and third links always forming therebetween an angle less than 180 degrees, preferably from 70 to 135 degrees; and a balance weight fixed to said other end of the third link.

The nature, utility, and further features of this invention will be apparent from the following detailed description with respect to a preferred embodiment of the invention when read in conjunction with the accompanying drawings briefly described below.

DETAILED DESCRIPTION OF THE INVENTION

Figure 8:
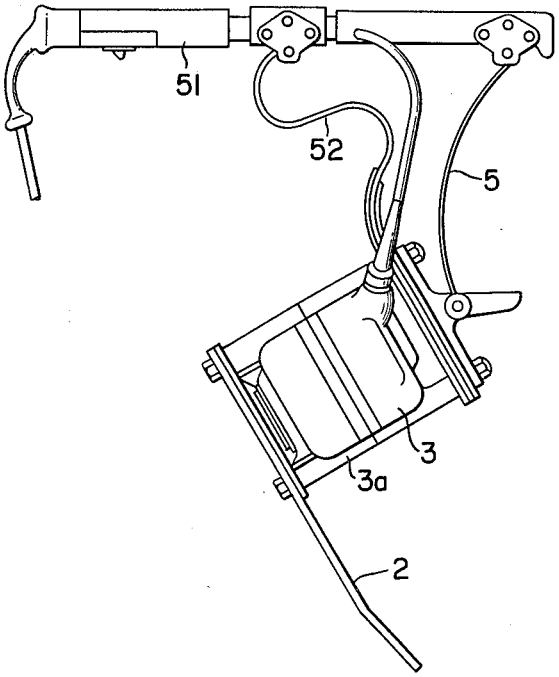
FIG. 8 PRIOR ART
FIG. 8 is a side view of a tie tamper known in the prior art.

As conducive to a full understanding of the nature and utility of this invention, a related tie tamper known in the prior art and the problems accompanying it will first be considered with reference to FIG. 8.

The known tie tamper comprises essentially a beater 2 to be thrust into railroad ballast gravel, a vibromotor 3 having an unbalance weight mounted on its rotor shaft to generate vibration, a vibromotor frame 3*a* supporting the vibromotor 3 and rigidly supporting the beater 2 thereby to transmit vibration from the vibromotor 3 to the beater 2, a handle 51, and a leaf spring 52 and a support spring 5 joining the handle 51 to the motor frame 3*a*.

The leaf spring 52 functions to reduce the transmission of the vibration of the vibromotor 3 to the handle 51. The support spring 5 functions to support the motor 3 and its frame 3*a* relative to the handle 51 and to determine the position and orientation of the motor 3 relative to the handle 51. Thus, the support spring 5 serves generally to facilitate the handling of the tie tamper when the operator gripes its handle 51 and carries out the work of tamping the ballast gravel underneath the lower surface of the ties of a railroad track; the purpose of this support spring 5 is not to suppress or reduce the vibration transmitted to the handle.

When the known tie tamper of the above described construction is hand held by an operator grasping the handle 51 to carry out the work of compacting ballast gravel, the forces due to vibration acting on the beater 2 when the beater is lifted into the air with the vibromotor 3 vibrating are different from those acting on the beater 2 when it is thrust into the ballast gravel. Consequently, the vibration transmitted to the handle 51 grasped by the operator is also different in the two cases. The reason for this is that, since a leaf spring having a linear characteristic is used as a vibration reducing member which connects the vibromotor 3 and the handle 51, when the work condition varies, the same vibration reducing effect cannot be sustained.

For example, when the leaf spring 52 is so selected that the vibration transmitted from the vibromotor 3 to the handle 51 will be a minimum with the beater 2 of the tie tamper raised into the air, the vibration transmission rate becomes great when the beater 2 is thrust into the ballast gravel since the frictional force between the beater 2 and the gravel acts on the beater 2. As a consequence, although the tie tamping work is not adversely affected, an intense vibration is transmitted to the hands of the operator. This increases the fatigue of the operator, who therefore cannot be expected to work over a long period.

Furthermore, in the case where the beater 2 enters deeply into the ballast gravel, and its movement is constrained or in the case where the ballast is consolidated, also, an intense vibration is transmitted via the handle 51 to the hands of the operator. The reasons for this are as follows. When the beater 2 enters deeply into the ballast gravel and becomes constrained in its motion, the extreme tip of the beater 2 becomes a pivot point, and the vibration of the vibromotor 3 is transmitted in a magnified state via the leaf spring 52 to the handle 51. When the ballast is consolidated, the beater 2 does not enter the ballast but travels irregularly over the surfaces of the gravel, its tip colliding successively with the gravel pieces. As a consequence, an impact induced by vibrations is transmitted through the leaf spring 52 to the handle 51.

That is, in these cases, also, since the leaf spring 52 has a linear characteristic, the same vibration reducing effect cannot be sustained as mentioned hereinabove when the work condition changes. Consequently, the operator's fatigue increases, and he becomes unable to work for a long time. The leaf spring 52 also is subjected to excessive stresses and may break off is some cases.

One example of a tie tamper constituting a preferred embodiment of this invention will now be described with reference to FIGS. 1 through 7.

Figure 1:
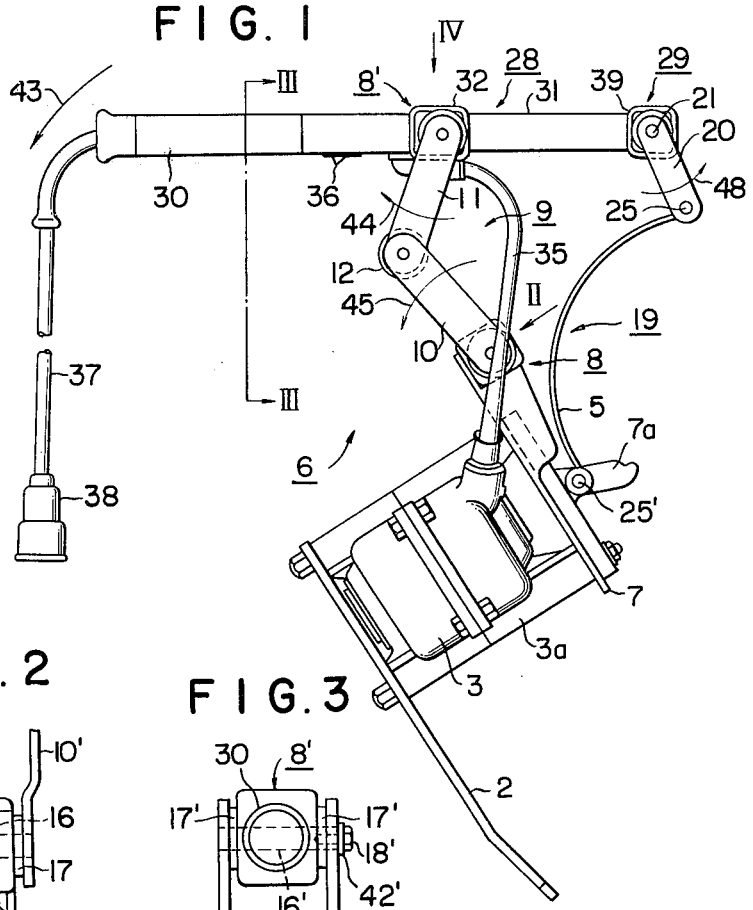
FIG. 1 is a side view of one example of a tie tamper constituting a preferred embodiment of this invention.
Figure 2:
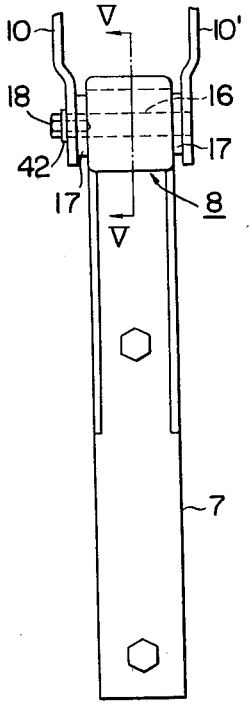
FIG. 2 is a relatively enlarged view as viewed in the arrow direction II in FIG. 1 of parts at which it is directed.
Figure 3:
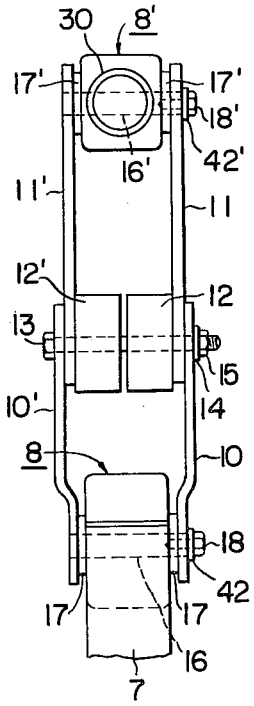
FIG. 3 is a relatively enlarged view as viewed in the plane indicated by line III—III in FIG. 1 in the arrow direction.

Referring first to FIG. 1, the tie tamper 6 comprises essentially: a vibromotor 3; a vibromotor frame 3*a* integrally supporting the vibromotor 3; a beater 2 rigidly fixed at its proximal end to one end of the vibromotor frame 3*a*; a lower first Neidhart damper 8 fixedly mounted on a bracket 7 having a projection 7*a* for transportation and fixed to the vibromotor frame 3*a* on the end thereof opposite from the beater 2; a link mechanism 9; a support mechanism 19; and a handle 28 connected to the vibromotor frame 3*a* by the link mechanism 9 via the first Neidhart damper 8 and bracket 7 by the support mechamism 19.

The link mechanism 9 is designed to suppress or reduce the transmission of vibration from the vibromotor 3 to the handle 28. As shown best in FIG. 3, this link mechanism 9 comprises: a pair of parallel lower links 10 and 10'; a transverse square shaft 16 fixed at its one end to the lower end of the link 10' and passed through the aforementioned first Neidhart damper 8; a pair of parallel upper links 11 and 11', a transverse square shaft 16' fixed at its one end to the upper end of the link 11' and passed through an upper second Neidhart damper 8'; balance weights 12 and 12' fixed to the inner surfaces of the lower ends of the upper links 11 and 11'; and a transverse bolt 13 passed through the upper ends of the links 10 and 10', the lower ends of the links 11 and 11' and the balance weights 12 and 12' and functioning to form a pin joint between the upper and lower pairs of links 11, 11' and 10, 10'. The bolt 13 is held in place by a nut 15 screwed thereonto over a washer 14.

The other ends of the transverse square shafts 16 and 16' not fixed to the links 11' and 10' respectively fit into square holes formed in the upper end of the link 11 (second link) and the lower end of the link 10 (first link) and are provided with tapped holes into which are screwed bolts 18 and 18' on washers 42 and 42'. Spacers 17, 17 are respectively interposed between the first Neidhart damper and the lower ends of the lower links 10 and 10', while spacers 17', 17' are respectively interposed between the second Neidhart damper and the upper ends of the upper links 11 and 11'. The second Neidhart damper is fixed to the handle 28 at a position near the middle part thereof as described hereinafter.

Figure 4:
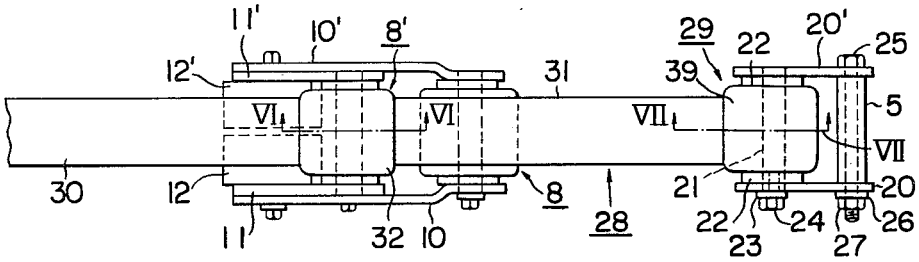
FIG. 4 is a relatively enlarged view as viewed in the arrow direction IV in FIG. 1 of parts at which it is directed.

The support mechanism 19, together with the link mechanism 9, supports the vibromotor 3 with respect to the handle 28 and restrictively determines the position of the vibromotor 3 relative to the handle 28. The support mechanism 19 comprises: a support spring 5, which is a curved leaf spring; a transverse bolt 25' constituting a pin joint between the lower end of the support spring 5 and the vibromotor frame 3*a* on the side thereof remote from the beater 2; a pair of parallel links 20 and 20'; a bolt 25 constituting a pin joint between the lower ends of the links 20 and 20' and the upper end of the support spring 5 interposed therebetween; and a transverse square shaft 21 fixed at its one end to the upper end of the link 20' as shown in FIG. 4 and passed through a third Neidhart damper 29 fixed to one end of the handle 28.

The other end of the square shaft 21 not fixed to the link 20' fits into a square hole in the upper end of the other link 20 (third link) and is provided with a tapped hole, into which a bolt 24 is screwed over a washer 23. Spacers 22, 22 are respectively interposed between the third Neidhart damper and the upper ends of the links 20 and 20'. The above mentioned bolt 25 is held in place by a nut 27 screwed thereonto over a washer 26.

The handle 28 has grip parts 30 and 31. The outer casings 32 and 39 of the second and third Neidhart dampers are secured to the grip part 31 by a method such as welding. The grip part 30 is secured by a method such as welding to the outer casing 32 of the second Neidhart damper on the side thereof opposite from the grip part 31. In the embodiment illustrated, the two grip parts 30 and 31 are substantially coaxial. An ON-OFF switch 36 for the vibromotor 3 is installed in a built-in state within the grip part 30 with its actuator knob or button projecting out of the grip part 30. The vibromotor 3 is driven by electric power supplied thereto from a power supply (not shown) through connector means 38, a cable 37, the switch 36 and a lead cable 35.

Figure 5:
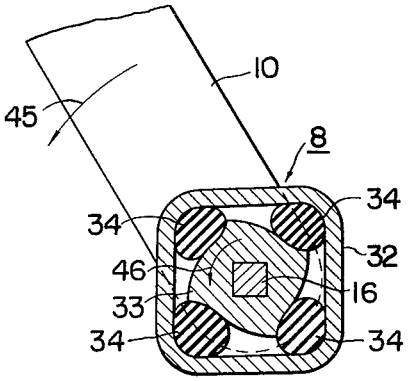
FIG. 5 is a section taken along the plane indicated by line V—V in FIG. 2 as viewed in the arrow direction.
Figure 6:
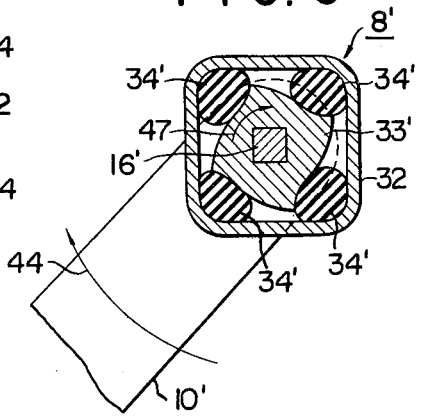
FIG. 6 is a section taken along the plane indicated by line VI—VI in FIG. 4 as viewed in the arrow direction.
Figure 7:
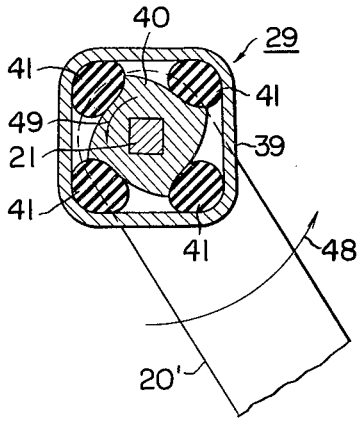
FIG. 7 is a section taken along the plane indicated by line VII—VII in FIG. 4 as viewed in the arrow direction.

The Neidhart dampers 8, 8', and 29 are known as Neidhart Rubber Springs (registered trademark). These dampers have cross sections as shown in FIGS. 5, 6, and 7 and are identical in construction, action, and effectiveness. More specifically, each damper 8 (8', 29) comprises an outer casing 32 (32', 39) of polygonal cross section, an inner shaft 33 (33', 40) having a square hole into which the afore-described square shaft 16 (16', 21) is fitted, and a plurality (four in the illustrated embodiment) of solid rubber cylinders 34 (34', 41) positioned at the corners of the casing.

When a torque acts on the outer casing 32 (32', 39) or the inner shaft 33 (33', 40), the rubber cylinders 34 (34', 41) are compressed as they roll between the outer casing 32 (32', 39) and the inner shaft 33 (33', 40). As a consequence, the rubber cylinders 34 (34', 41) exhibits a nonlinear spring characteristic, and, at the same time, a damping action due to rolling friction between the rubber cylinders 34 (34', 41), the inner surface of the outer casing 32 (32', 39), and the outer surface of the inner shaft 33 (33', 40) is obtained. Accordingly, by appropriately selecting the nonlinear characteristics of the dampers 8, 8', and 29, the transmission of vibration from the vibromotor 3 to the grip parts 30 and 31 of the handle 28 can be effectively suppressed even when the work condition of the tie tamper varies.

The vibration of vibromotor 3 is transmitted by way of the damper 8, links 10 and 10', links 11 and 11', and the damper 8' of the handle 28 to the grip parts 30 and 31 of the handle 28. In this case, however, since the links 10 and 10' and the links 11 and 11' are pin connected by the bolt 13 held in place by the nut 15 on the washer 14, a discontinuous point of vibration transmission is formed, whereby a secondary vibration is generated in the axial direction of the bolt 13. We have found that this secondary vibration is transmitted to the handle 28 and lowers the effectiveness of the link mechanism 9 in suppressing vibration.

As a result of various experiments we have carried out with the aim of preventing the generation of this secondary vibration, we have found that, by mounting balance weights 12 and 12' at the joint part between the pair of links 11 and 11' and the pair of links 10 and 10', the generation of this secondary vibration can be prevented. Good experimental results were obtained when, with the use of an alternating-current electric motor for the vibromotor 3, the sum of the weights of the balance weights was made equal to approximately 600 grams for a frequency of 60 Hz and to approximately 1,000 grams for a frequency of 50 Hz.

Furthermore, the vibration of the vibromotor 3 is transmitted by way of the support spring 5 and the links 20 and 20' of the support mechanism 19 to the handle 28, but since the support spring 5 is mounted near the nodal point of the vibration of the vibromotor 3, the transmitted vibration is of low intensity and, moreover, is suppressed by the third Neidhart damper provided at the end of the handle 28. As a result, almost no vibration is transmitted to the grip parts 30 and 31 of the handle 28.

The tie tamper 6 of the above described construction constituting one preferred embodiment of this invention is manipulated and operates in the following manner.

The switch 36 is turned ON to start the vibromotor 3 in its vibration generating operation, whereby the beater 2 starts to vibrate and is ready to compact ballast gravel. Ordinarily, the operator grasps the grip parts 30 and 31 of the handle 28 with both hands, pushes down on the grip part 30 while lifting the grip part 31 thereby to rotate the handle 28 in the arrow direction 43 shown in FIG. 1 so as to thrust the beater 2 into the ballast gravel lying below the lower surface of a tie, whereupon the links 11 and 11' rotate in the arrow direction 44, while the links 10 and 10' rotate in the arrow direction 45. As a consequence, the inner shaft 33 of the first damper rotates in the arrow direction 46 shown in FIG. 5, and the inner shaft 33' of the second damper rotates in the arrow direction 47 shown in FIG. 6.

Thus, the vibration from the vibromotor 3 is suppressed in two stages by the first and second Neidhart dampers, and the generation of amplified secondary vibration is prevented by the balance weights 12 and 12' installed at the joint between the links 10 and 10' and the links 11 and 11'. Therefore, the vibration finally reaching the grip parts 30 and 31 of the handle 28 has been reduced to an extremely low intensity.

As another result of the above described rotation of the handle 28 in the arrow direction 43 as indicated in FIG. 1, the links 20 and 20' of the support mechanism 19 rotate in the arrow direction 48 in FIG. 1, and the inner shaft 40 of the third damper rotates in the arrow direction 49 as shown in FIG. 7. Therefore, in addition to the fact that the vibration transmitted from the vibromotor through the support mechanism 19 is of low intensity as mentioned hereinbefore, whatever vibration there is, upon reaching the third damper, is greatly reduced thereby, whereby almost no vibration is transmitted via the support mechanism 19 to the grip parts 31 and 30 of the handle 28.

When the beater 2 enters deeply into the ballast gravel and is constrained in its movements, or when the ballast is in a compacted state, if the nonlinear spring characteristics of the first and second dampers have been suitably selected beforehand, the spring constants of the dampers can be changed by manipulating the handle 28 to change the rotational angle, whereby intense vibration or impact-like vibration can be prevented from being transmitted through the handle 28 to the hands of the operator.

While, in the above described embodiment of the invention, the second damper is secured directly to the grip part 30 of the handle 28, it may be mounted indirectly by way of a mounting plate or bracket to the grip part 30.

In the use of the tie tamper of the above described construction and operation according to this invention, the vibration from the vibromotor to the handle is reduced to an extreme degree in comparison with known tie tampers. In addition, even when the work condition varies, by changing the spring constants of the dampers by manipulating the handle, intense vibration or impact-like vibration can be prevented from reaching the hands of the operator. Accordingly, the operator's fatigue is reduced, whereby the operator can work for a long time, and, moreover, the work efficiency is increased.

What we claim is:

1. A tie tamper comprising:

a motor adapted to generate vibration as output;

a beater designed to be thrust at a distal end thereof into ballast gravel and rigidly fixed at its proximal end to the motor to be vibrated thereby;

a handle to be grasped by an operator of the tie tamper;

a link mechanism connecting an intermediate part of the handle to the motor and comprising a first Neidhart damper secured to the motor and having a non-cylindrical shaft disposed therein, a second Neidhart damper secured to said intermediate part of the handle and having a non-cylindrical shaft disposed therein, a first link fixed at one end thereof to the shaft of the first Neidhart damper, and a second link fixed at one end thereof to the shaft of the second Neidhart damper and pin-connected at the other end thereof to the other end of the first link, the first and second links always forming therebetween an angle less than 180 degrees;

a support mechanism connecting one end of the handle to the motor and comprising a support spring connected at one end thereof to a part of the motor, a third Neidhart damper secured to said one end of the handle and having a non-cylindrical shaft disposed therein, and a third link fixed at one end thereof to the non-cylindrical shaft and connected at the other end thereof to the other end of the support spring; and a balance weight fixed to said other end of the second link.

2. A tie tamper according to claim 1, wherein the motor is originally supported and partly enclosed by a motor frame, and the second Neidhart damper is mounted on a bracket fixed to the motor frame.

3. A tie tamper according to claim 1, wherein each of the first, second, and third links comprises a pair of parallelly spaced-apart links.

* * * * *